US005295865A

United States Patent [19]

Endo et al.

[11] Patent Number: 5,295,865

[45] Date of Patent: Mar. 22, 1994

[54] RUBBER PLUG FOR WATERPROOF CONNECTOR

[75] Inventors: Takayoshi Endo; Sakai Yagi; Kimihiro Abe, all of Shizuoka, Japan

[73] Assignee: Yazaki Corporation, Tokyo, Japan

[21] Appl. No.: 934,231

[22] Filed: Aug. 25, 1992

[30] Foreign Application Priority Data

Sep. 12, 1991 [JP] Japan ..... 3-233009

[51] Int. Cl.[5] ..... H01R 13/40

[52] U.S. Cl. ..... 439/587; 439/271

[58] Field of Search ..... 439/271-283, 439/736

[56] References Cited

U.S. PATENT DOCUMENTS 4,735,581 4/1988 Endo et al. ..... 439/587

4,895,533 1/1990 Yagi et al. ..... 439/278

FOREIGN PATENT DOCUMENTS 1196402 11/1985 Canada ..... 439/271

*Primary Examiner*—David L. Pirlot

*Attorney, Agent, or Firm*—Sughrue, Mion, Zinn, Macpeak & Seas

[57] ABSTRACT

This invention relates to a rubber plug for a waterproof connector used in a wire harness for an automobile, and an object thereof is to make the movement of the plug smooth when feeding the plug by a part feeder to an assembling line where the plug is connected to a metal terminal. According to the present invention, the rubber plug comprises a contact portion of a synthetic resin formed to extend axially from a seal portion of a rubber plug which extends continuously from a metal terminal-connection tubular portion having a wire passage internal bore, the seal portion being adapted to be in intimate contact with an inner wall of a connector housing. The rubber plug is moved with the sliding contact portion held in contact with a feed guide rail of a part feeder.

5 Claims, 5 Drawing Sheets

FIG. 14
PRIOR ART
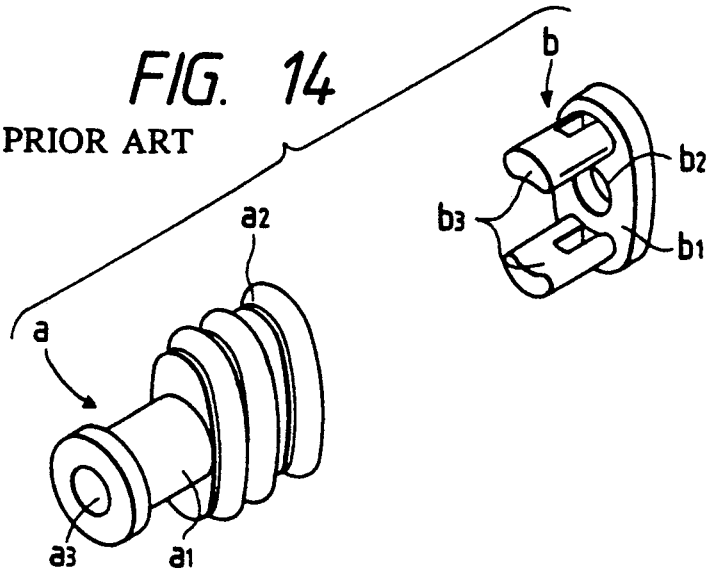
FIG. 15
PRIOR ART
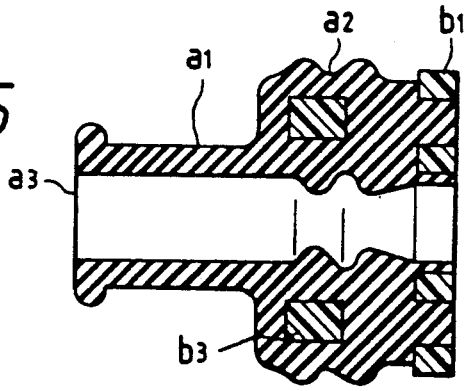
PRIOR ART FIG. 16
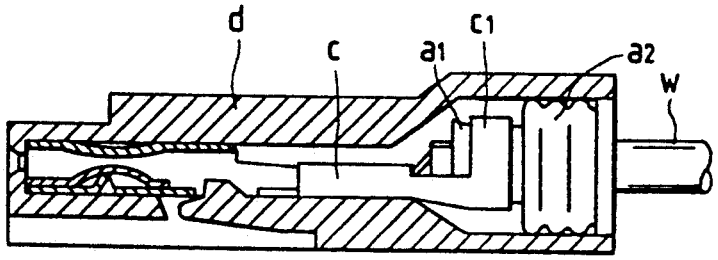
FIG. 17
PRIOR ART
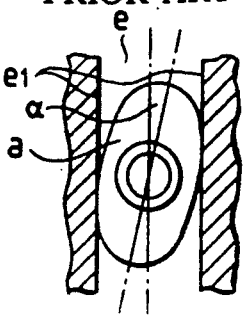

RUBBER PLUG FOR WATERPROOF CONNECTOR

BACKGROUND OF THE INVENTION

This invention relates to a rubber plug for a waterproof connector used mainly in a wire harness of an automobile.

In FIG. 14, a waterproof plug a of soft rubber for a waterproof connector has a seal portion $a_2$ of an oval shape extending continuously from a metal terminal-connection tubular portion $a_1$, and this plug has a central wire passage bore $a_3$.

A reinforcement member b of a synthetic resin includes a base plate portion $b_1$ of an oval shape having a wire passage hole $b_2$ formed through a central portion thereof. Support posts $b_3$ are formed respectively on opposite side portions of the base plate portion $b_1$. The reinforcement member b is integrally connected to the waterproof plug a, with the support posts $b_3$ embedded in the seal portion $a_3$ (see FIG. 15).

In use, the connection tubular portion $a_1$ through which an electric wire w is passed is compressively clamped by a wire connection portion $c_1$ of a metal terminal c, and when the metal terminal c is inserted into a connector housing d, the seal portion $a_2$ is held in intimate contact with an inner wall of the connector housing d (Japanese Laid-Open Utility Model Application No. 1-121276).

When the waterproof plug a is to be automatically fed by a (component) part feeder, the oval seal portion $a_2$ of the waterproof plug a moves in contact with wall surfaces $e_1$ of a feed guide rail e of the part feeder, and at this time since the angle $\alpha$ of deflection of the waterproof plug a relative to the direction of movement is large, there is a drawback that the waterproof plug can not be smoothly moved.

SUMMARY OF THE INVENTION

With the above problem in view, it is an object of this invention to provide an arrangement by which an automatic feed of a waterproof plug in a part feeder can be effected smoothly.

According to a first aspect of the present invention, there is provided a waterproof plug comprising a sliding contact portion of a synthetic resin is formed to extend axially from a seal portion of the rubber plug which extends continuously from a metal terminal-connection tubular portion having a wire passage internal bore, said seal portion being adapted to be in intimate contact with an inner wall of a connector housing; and the rubber plug is moved with said sliding contact portion held in contact with a feed guide rail of a part feeder.

According to a second aspect of the present invention, there is provided a waterproof plug comprising a seal portion, adapted to be in intimate contact with an inner wall of a connector housing, extends continuously from a metal terminal-connection tubular portion having a wire passage internal bore; a sliding contact portion of a synthetic resin is formed on an end portion of said seal portion; and a pair of parallel rail contact surfaces are formed on said sliding contact portion of a synthetic resin.

When the rubber plug for a waterproof connector is to be fed by a part feeder, the sliding contact portion of a synthetic resin is held in contact with the feed guide rail of the part feeder, thereby making the movement of the plug smooth.

BRIEF DESCRIPTION OF THE DRAWINGS

FIG. 14 is an exploded perspective view of a conventional waterproof plug for a waterproof connector;

FIG. 15 is an axial cross-sectional view of the above conventional plug,

FIG. 16 is a view showing the above conventional plug in use; and

FIG. 17 is a view showing the condition of transfer of the above conventional plug by a part feeder.

DETAILED DESCRIPTION OF THE PREFERRED EMBODIMENTS

Figure 1:
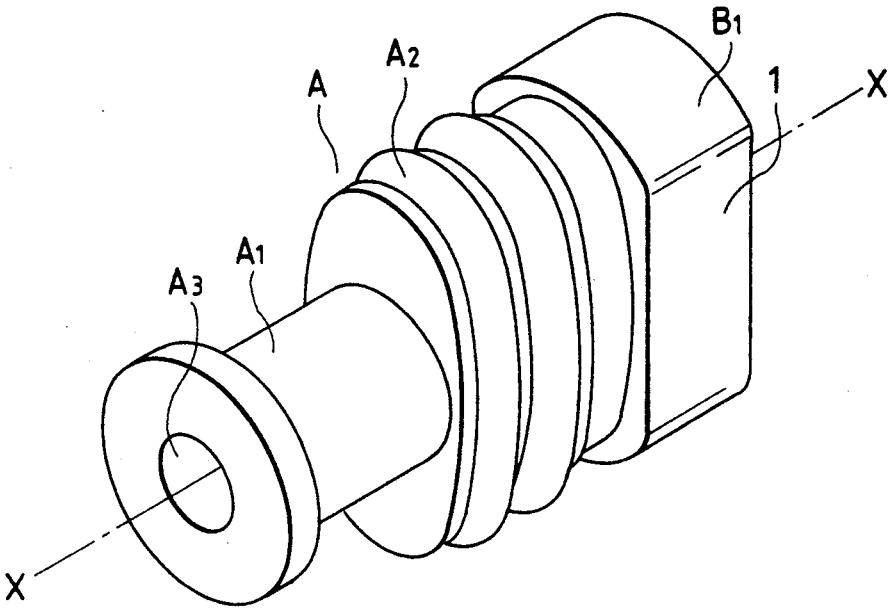
FIG. 1 is a perspective view of a waterproof plug for a waterproof connector provided in accordance with the present invention.

Referring to FIG. 1, a rubber plug A of soft rubber for a waterproof connector has a seal portion $A_2$ of an oval shape extending continuously from a metal terminal-connection tubular portion $A_1$, and this plug has a central wire passage bore $A_3$.

Figure 2:
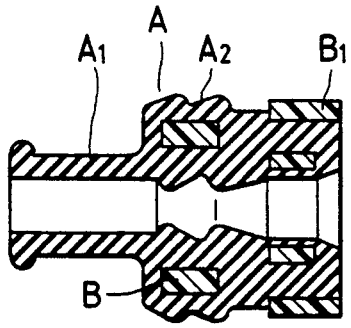
FIG. 2 is an axial cross-sectional view of the plug of FIG. 1.
Figure 3:
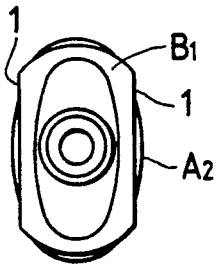
FIG. 3 is a bottom view of the above plug.

A sliding contact portion $B_1$ of a synthetic resin is provided on an end portion in axis X of the seal portion $A_2$. The sliding contact portion $B_1$ is formed integrally with a reinforcement member B embedded in the seal portion $A_2$ (see FIG. 2).

The sliding contact portion B has a pair of parallel rail contact surfaces 1 and 1 for a feed guide rail of a part feeder, the surfaces 1 and 1 extending in the direction of a longer diameter of the oval seal portion $A_2$.

Figure 4:
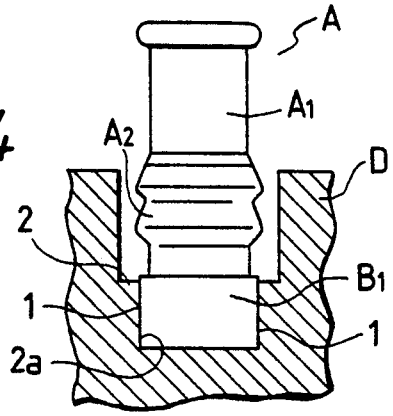
FIG. 4 is a view showing the condition of transfer of the above plug by a part feeder.
Figure 5:
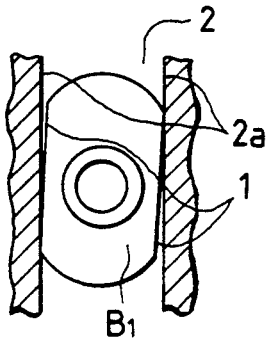
FIG. 5 is a plan view of a portion of FIG. 4.

FIGS. 4 and 5 show a condition in which the waterproof plug A is fed by the part feeder D. Since the rail contact surfaces 1 and 1 of the sliding contact portion $B_1$ are in contact with side surfaces 2*a* of the feed guide rail 2, respectively, no deflection occurs, and the resistance is low, and therefore the plug is smoothly moved.

Figure 6:
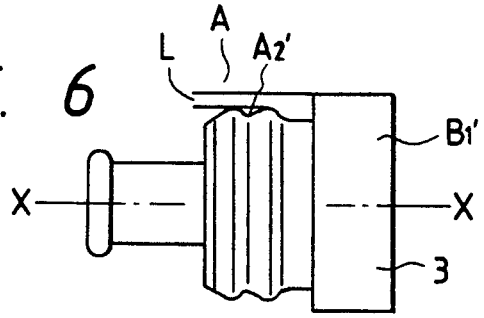
FIG. 6 is a front-elevational view of another embodiment of the present invention.
Figure 7:
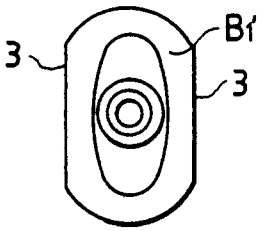
FIG. 7 is a bottom view of the construction of FIG. 6.
Figure 8:
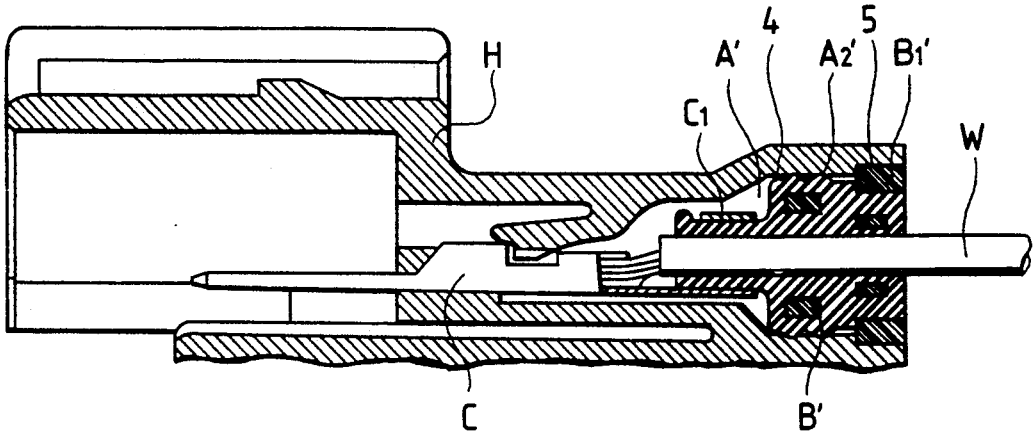
FIG. 8 is a cross-sectional view showing the above construction in use.

In an embodiment of FIGS. 6 to 8, a sliding contact portion $B_1'$ of a reinforcement member B' provided on a waterproof plug A' bulges much beyond a seal portion $A_2$, as at L, and rail contact surfaces 3 and 3 are extended outwardly of the seal portion $A_2$, in a direction intersecting the axial direction X of the seal portion $A_2$.

As shown in FIG. 8, the waterproof plug A', together with a wire W, is compressively clamped by a wire connection portion $C_1$ of a metal terminal C, and is inserted into a connector housing H. In this condition, the seal portion $A_2'$ is held in intimate contact with an inner wall 4 of the connector housing H, and the bulged sliding contact portion $B_1'$ is fitted in a bulge chamber 5, provided at the rear end portion of the connector housing H, thereby effecting the positioning.

Figure 9:
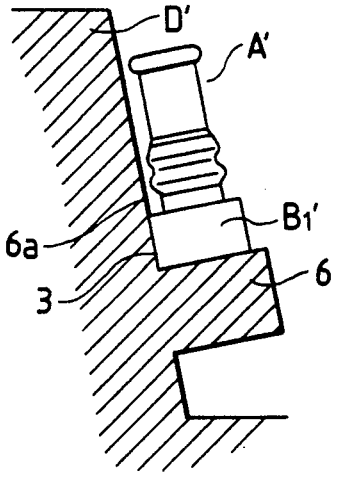
FIG. 9 is a view showing the condition of transfer of the above construction by a part feeder.

In the above embodiment, when the waterproof plug A' is to be fed by a part feeder D', the rail contact surface 3 of the sliding contact portion $B_1'$ is in contact with an inclined side surface 6*a* of a feed guide rail 6, and therefore the plug is smoothly moved (see FIG. 9).

Figure 10:
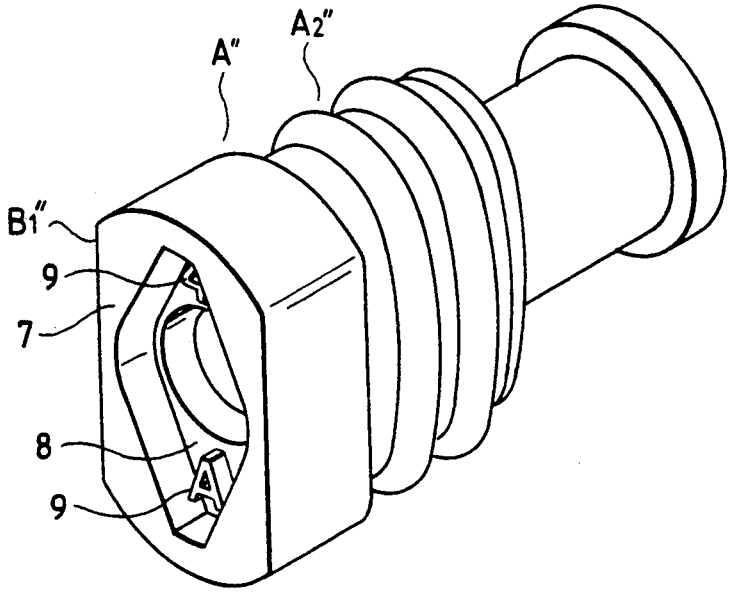
FIG. 10 is a perspective view of a further embodiment of the present invention.
Figure 11:
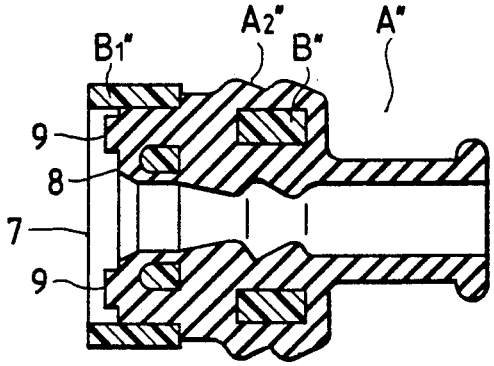
FIG. 11 is an axial cross-sectional view of the construction of FIG. 10.
Figure 12:
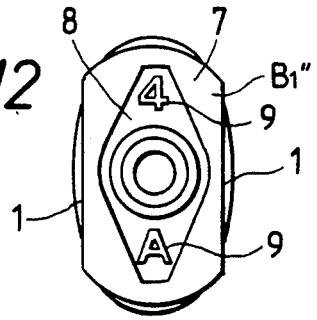
FIG. 12 is a bottom view of the above construction.
Figure 13:
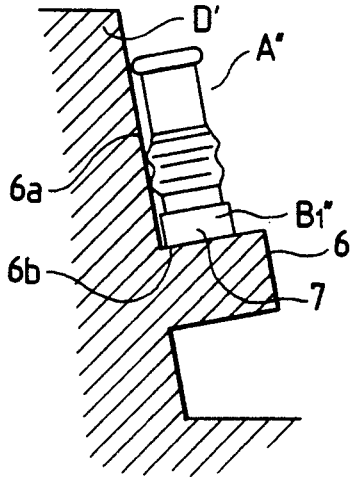
FIG. 13 is a view showing the condition of transfer of the above construction by a part feeder.

In an embodiment of FIGS. 10 to 12, an end face 8 of a seal portion $A_2''$ is disposed back inward from an axial end face 7 of a slide contact portion $B_1''$ of a reinforcement member B" provided on a waterproof plug A", and indicator marks 9 are formed on the retracted end face 8. The slide contact portion $B_1''$ has rail contact surfaces 1 and 1 as described above in FIG. 1.

In the above embodiment, when the waterproof plug A" is to be fed by a part feeder D", the end face 7 of the slide contact portion $B_1''$ is held against a bottom surface 6*b* of a feed rail 6, and the seal portion $A_2''$ is in contact with a side surface 6*a*. Since the end face 7 supporting the weight offers a less sliding resistance, the plug is smoothly moved.

The seal portion and the slide contact portion may have any other shape (e.g. circular shape) than an oval shape.

As described above, in the present invention, when the waterproof plug (whose main portion is made of soft rubber) for a waterproof connector is to be fed to an assembling line by the part feeder, the plug can be smoothly moved by means of the associated sliding contact portion of a synthetic resin.

What is claimed is:

1. A rubber plug for a water proof connector comprising:

a tubular portion to which a metal terminal is securable;

a seal portion extending continuously from said tubular portion for sealingly contacting a housing in which said plug is disposed;

a reinforcement portion embedded in said seal portion for reinforcing said seal portion;

a sliding contact member, made of a synthetic resin, formed integrally with said reinforcement portion and having an exposed exterior surface, wherein when said plug is conveyed by a part feeder said exterior surface of said contact member slidably contacts a guide surface of said feeder enabling smooth movement of said plug therealong.

2. A rubber plug for water proof connector as claimed in claim 1, wherein an end portion of said seal portion is recessed from an end face of said sliding contact member in said plug insertion direction.

3. A rubber plug for water proof connector as claimed in claim 1, wherein said seal portion has one of an oval shape and a circular shape.

4. A rubber plug for water proof connector as claimed in claim 3, wherein said sliding contact member has a pair of parallel rail contact surfaces extending in a direction of a longer diameter of said seal portion with said oval shape.

5. A rubber plug for water proof connector as claimed in claim 4, wherein said rail contact surfaces extend beyond said seal portion in a direction intersecting said plug insertion direction.

* * * * *